US007513816B1

(12) United States Patent
McCullough et al.

(10) Patent No.: US 7,513,816 B1
(45) Date of Patent: Apr. 7, 2009

(54) BEADED STRAPS AND METHODS OF MANUFACTURING THE SAME

(75) Inventors: Lester E. McCullough, Glendale, CA (US); Gina L. Hueston, Newport Beach, CA (US)

(73) Assignee: Confectionz, LLC, Newport Beach, CA (US)

( * ) Notice: Subject to any disclaimer, the term of this patent is extended or adjusted under 35 U.S.C. 154(b) by 0 days.

(21) Appl. No.: 12/025,571

(22) Filed: Feb. 4, 2008

(51) Int. Cl.
*A41D 3/00* (2006.01)

(52) U.S. Cl. ..... 450/86; 450/1; 2/338

(58) Field of Classification Search ..... 450/86, 450/88, 1; 2/106, 105, 73, 67, 336, 338, 2/326–331, 312, 78.1–78.4; D2/700, 701, D2/703, 706, 708, 731, 734, 793
See application file for complete search history.

(56) References Cited

U.S. PATENT DOCUMENTS

| | | | | |
|---|---|---|---|---|
| 6,086,451 | A * | 7/2000 | Fernandes | 450/86 |
| D433,650 | S | 11/2000 | Gable | |
| 6,186,861 | B1 * | 2/2001 | Flaherty | 450/1 |
| 6,517,409 | B2 * | 2/2003 | Flaherty | 450/1 |
| 6,547,636 | B1 | 4/2003 | Cato | |
| D519,261 | S | 4/2006 | Reis | |
| 7,396,273 | B2 * | 7/2008 | Styles-Gaviria et al. | 450/86 |
| 2007/0105482 | A1 | 5/2007 | Styles-Gaviria | |

FOREIGN PATENT DOCUMENTS

GB 2419801 A 5/2006

OTHER PUBLICATIONS www.strapcouture.com, StrapCouture, Luxurious Fashion Bra Straps, printed Jan. 22, 2008.
www.africamybra.com/africa-my-bra.php, Africa my Bra, Beaded Bra Straps & Accessories, printed Jan. 22, 2008.
www.brastrapsaustralia.com.au/proddetail.php?prod=F012B-B1, Bra Straps Australia, Product Detail F012B-B1, printed Jan. 22, 2008.
www.peekaboostrapz.com/peekaboo_how_to.html, Peek-A-Boo Strapz, Welcome to Peek-A-Boo Strapz, printed Oct. 30, 2007.
www.sassystraps.net/images/straps1.gif, printed Oct. 30, 2007.

(Continued)

*Primary Examiner*—Gloria Hale
(74) *Attorney, Agent, or Firm*—Barcelo & Harrison, LLP

(57) ABSTRACT

Beaded straps for use with articles of clothing and methods of manufacturing them are disclosed. In one embodiment, a beaded brassiere strap comprises a main portion and an elastic portion. To provide the main portion, a segment of relatively inelastic beading wire is attached to a first hook and threaded through one or more bead pattern sections in a first direction. The relatively inelastic beading wire is then threaded through a connector bead, then threaded through one or more bead pattern sections in a second direction substantially opposite the first direction, then attached to the first hook. To provide the elastic portion, a segment of relatively elastic wire is also threaded through the connector bead, then loaded with beads, then attached at both ends to a second hook, such that the first and second hooks are at substantially opposite ends of the completed strap.

12 Claims, 2 Drawing Sheets

OTHER PUBLICATIONS media.www.csucauldron.com/media/storage/paper516/news/2006/09/05/ArtsEntertainment/Beaded.Bra.Straps.Gives.Hope.To.Women.In.Columbia-2257047.shtml, Sep. 5, 2006.

www.bstraps.com/pdf/wear.pdf, BSTRAPS—Designed to BSeen, 2007.

www.strappys.com, Strappys decorative bra straps, 2008.

* cited by examiner

CON-0002-P

BEADED STRAPS AND METHODS OF MANUFACTURING THE SAME

BACKGROUND OF THE DISCLOSURE

1. Field of the Disclosure

The disclosure generally to the field of clothing accessories, more particularly to beaded straps for use in applications such as decorative straps for brassieres ("bras"), and to methods of manufacturing them.

2. General Background

Functional requirements of certain straps used with items of clothing are to help keep items of clothing in a desired position on the user's body or to support parts of a user's body. Brassiere straps, for example, help keep a brassiere in place and support a woman's breasts, typically by means of elastic bands stretched from the back to the front of a brassiere that distribute weight more evenly across a woman's shoulders and apply upward force on the breasts.

Such straps are sometimes visible, for example when a woman wears a strapless dress or a strapless top, or a top with narrow shoulder straps or a wide neck opening, thereby exposing brassiere straps that would otherwise be hidden underneath other garments. In such situations, it is sometimes undesirable for the straps to be visible, for various reasons including aesthetics. Strapless brassieres are available, but may not provide an acceptable option in certain situations, for example because they may not provide sufficient support for some women. Similarly, not wearing a brassiere would eliminate undesirable issues associated with visible brassiere straps, but may not be an acceptable option in certain situations for some women.

Various decorative straps such as decorative brassiere straps have been developed. Such straps are intended to be aesthetically pleasing, and therefore are intended to be visible by others during normal use. By using decorative brassiere straps, a user may gain the functional advantages of traditional brassiere straps, without aesthetic or other problems sometimes associated with the visibility of brassiere straps. Many designs and styles of decorative straps are available, including beaded straps, straps based on interlinked elements, and straps based on decorative elements that are sewn onto or otherwise attached to traditional straps.

Certain beaded decorative straps may be associated with various problems. For example, depending on the particular length of a user's body measured from the rear to the front of a brassiere over the user's shoulder, if the underlying strap material (e.g., beading wire) stretches, individual beads may separate, thereby exposing the underlying material and causing undesirable aesthetic effects or discomfort due to pinching of the user's skin. As another example, for beaded brassiere straps based on elastic wires, repeated use and stretching of the underlying material may cause it to lengthen permanently over time and render the strap unusable (e.g., incapable of providing sufficient support) or prone to breaking. As another example, some decorative beaded brassiere straps may include adjuster portions (typically at the rear) to modify the length of the straps, but these may be undesirable, since the adjuster portions may not aesthetically match the beaded portions of the straps.

It is desirable to address the limitations in the art.

SUMMARY

Beaded straps for use with articles of clothing and methods of manufacturing them are disclosed. In one embodiment, a beaded brassiere strap comprises a main portion and an elastic portion. To provide the main portion, one end of a segment of relatively inelastic beading wire is attached to a first hook, and the free end of the beading wire is then threaded through one or more bead pattern sections in a first direction. The free end of the relatively inelastic beading wire is then threaded through a connector bead, then threaded through one or more bead pattern sections in a second direction substantially opposite the first direction, then attached to the first hook. To provide the elastic portion, a segment of relatively elastic wire is also threaded through the connector bead, then loaded with beads, then attached at both ends to a second hook, such that the first and second hooks are at substantially opposite ends of the completed strap. Other aspects and advantages of various aspects of the present invention can be seen upon review of the figures, the detailed description, and the claims that follow.

BRIEF DESCRIPTION OF THE DRAWINGS

By way of example, reference will now be made to the accompanying drawings, which are not to scale.

DETAILED DESCRIPTION

Those of ordinary skill in the art will realize that the following description of the present invention is illustrative only and not in any way limiting. Other embodiments of the invention will readily suggest themselves to such skilled persons, having the benefit of this disclosure. Reference will now be made in detail to specific implementations of the present invention as illustrated in the accompanying drawings. The same reference numbers will be used throughout the drawings and the following description to refer to the same or like parts.

Figure 1:
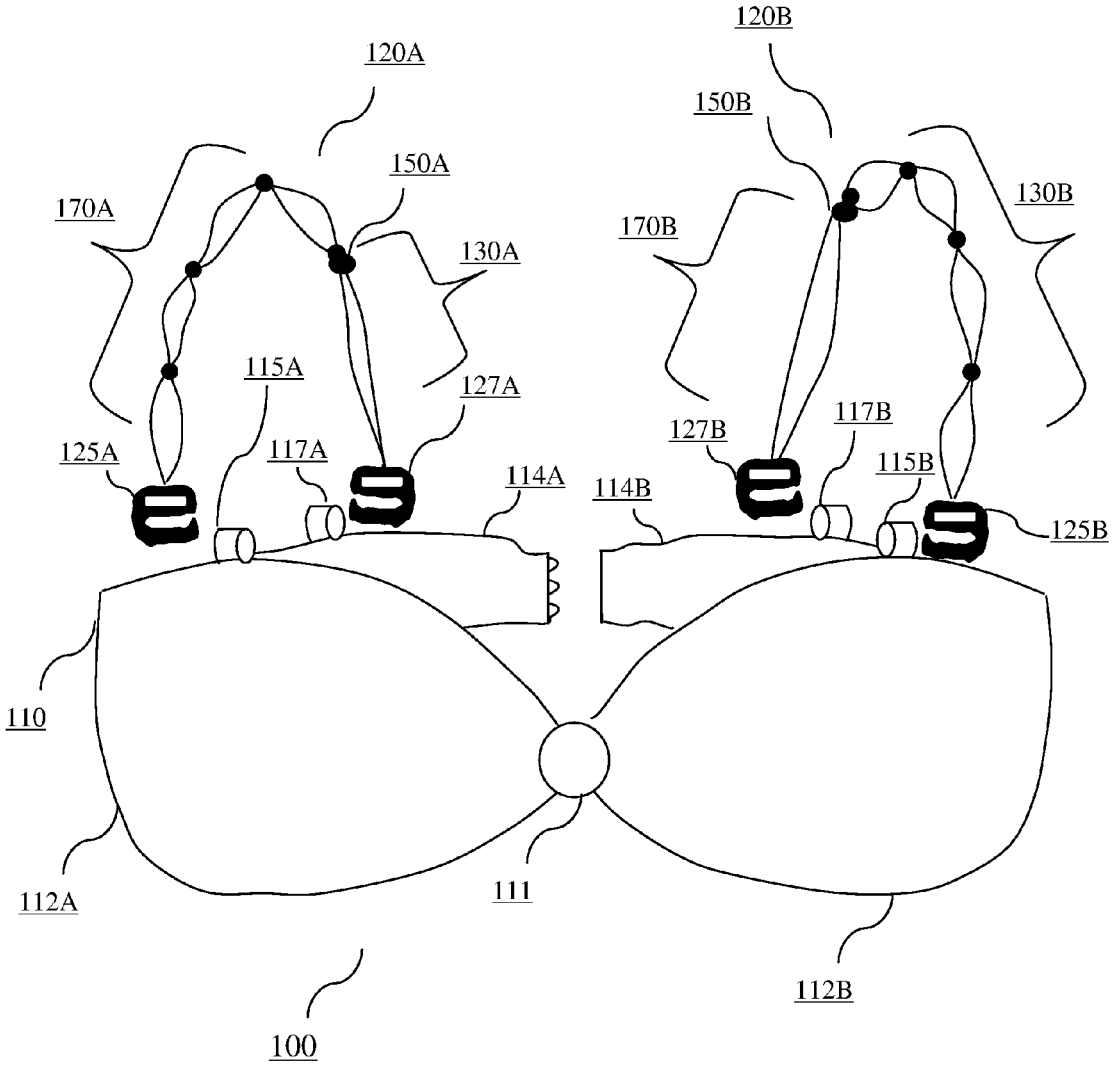
FIG. 1 illustrates a brassiere system according to aspects of the present invention, comprising a brassiere and a couple of exemplary beaded brassiere straps.

FIG. 1 illustrates a brassiere system 100 according to aspects of the present invention, including a brassiere 110 and a couple of exemplary beaded brassiere straps 120A and 120B. As shown in FIG. 1, the beaded brassiere straps 120A and 120B are substantially identical, but this is not necessary in every embodiment. Brassiere 110 includes brassiere strap receiving means 115A, 115B, 117A, and 117B, which as shown in FIG. 1 comprise four fabric loops capable of being removably attached to respective brassiere attachment means (e.g., plastic or metal brassiere strap hooks 125A, 125B, 127A, and 127B) on a strap (120A, 120B). Fabric loop 115A is located on a top portion of a right brassiere cup 112A, and mates with front strap hook 125A on a first brassiere strap 120A, while fabric loop 117A is located on a top portion of the right side of a back strap 114A, and mates with rear strap hook 127A on the first brassiere strap 120A. Fabric loop 115B is located on a top portion of a left brassiere cup 112B, and mates with front strap hook 125B on a second brassiere strap 120B, while fabric loop 117B is located on a top portion of the left side of a back strap 114B, and mates with rear strap hook 127B on the second brassiere strap 120B. Depending on the requirements of each particular embodiment, the mating mechanism between brassiere strap receiving means 115A, 115B, 117A, and 117B, on the one hand, and brassiere strap hooks 125A, 125B, 127A, and 127B, on the other hand, may be implemented by various other means, such as snaps, VELCRO™ fasteners, metal or plastic rings joining two loops of fabric, or sewing (in the case of more permanently attached components), for example. Also, depending on particular designs, the back strap portions 114A and 114B may be implemented as a single continuous back strap, in which case the brassiere may open via a mechanism 111 located at the front of the brassiere, such as a front brassiere hook, for example.

Still referring to the exemplary implementation of FIG. 1, each beaded brassiere strap (120A, 120B) includes a main portion (130A, 130B) (shown as being in the front of the strap in FIG. 1) and an elastic portion (170A, 170B) (shown as being in the rear of the strap in FIG. 1). In certain embodiments, each main portion (130A, 130B) is coupled to its respective elastic portion (170A, 170B) by means of a connector bead (150A, 150B), as will now be explained in more detail by way of reference to FIG. 2.

Figure 2:
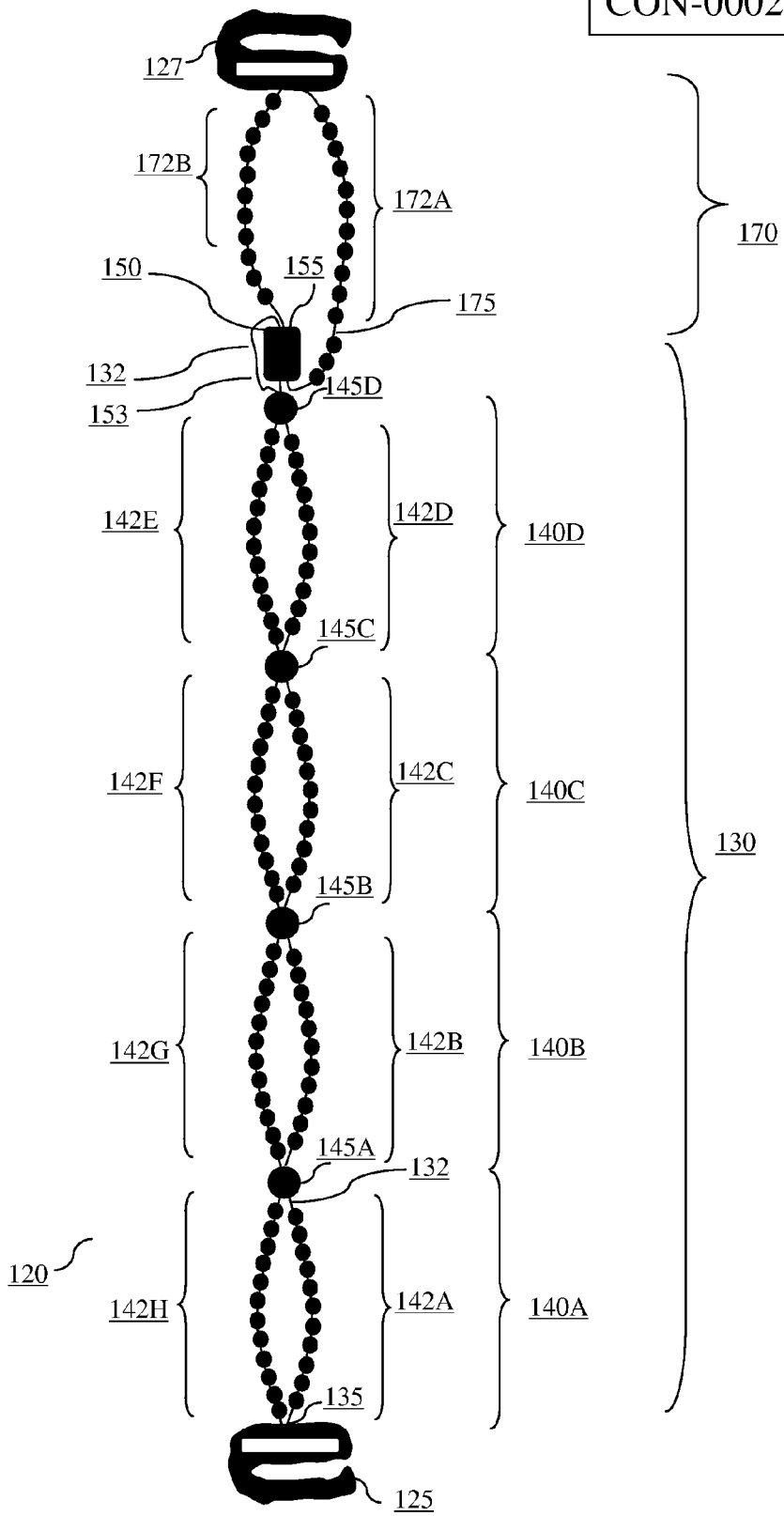
FIG. 2 illustrates an exemplary beaded brassiere strap according to aspects of the present invention, as well as a method of manufacturing it.

FIG. 2 illustrates an exemplary beaded brassiere strap according to aspects of the present invention, as well as a method of manufacturing it. To provide the main portion, a first end 135 of a segment of relatively inelastic beading wire 132 is attached to a first hook 125 (e.g., by tying it to a portion of hook 125). Alternatively, before attachment to first hook 125, the first end 135 of the relatively inelastic beading wire 132 may temporarily be provided with a stopper knot or wrapped with tape or other suitable materials so as to facilitate beading (i.e., so that beads threaded through wire 132 do not fall out from first end 135 during the beading process. Suitable materials for wire 132 include monofilament nylon wire rated at 25-pound tensile strength and having a nominal diameter of 0.5 mm, commercially available in a variety of colors (including clear wire). In one embodiment, wire 132 is approximately 40 inches long, but a variety of sizes may be appropriate depending on each particular implementation.

Once the first end 135 of wire 132 is attached to first hook 125 or otherwise temporarily adapted so that beads do not fall out of the wire 132 as described above, the free end of wire 132 is threaded through one or more bead pattern sections 140 in a first direction. One example is shown in FIG. 2, but a variety of configurations are possible. As shown in FIG. 2, the main beaded portion 130 of an exemplary brassiere strap 120 according to aspects of the present invention comprises four substantially identical bead pattern sections 140A, 140B, 140C, and 140D, each approximately 2 inches long, although there is no requirement that any of the sections be identical, that they be a certain length, or that a particular number of sections be used. These and other parameters can be selected from a variety of possible configurations, depending on the functional and aesthetic requirements of each implementation.

Still referring to the example shown in FIG. 2, the first bead pattern section 140A is configured by stringing any suitable pattern of beads 141 through the free end of wire 132 until a first portion 142A of the first bead pattern section 140A is completed. For example, a plurality of substantially identical small glass beads may be strung through the free end of wire 132 to provide a 2-inch section 142A, but the beads may comprise a variety of shapes, sizes and colors so as to generate any given desired pattern. Suitable beads may include commercially available "10/0" or "8/0" beads having a through-hole of approximately 1 mm diameter.

Once section 142A is completed, a separator bead 145A is strung through the free end of wire 132. Separator beads (e.g., 145A, 145B, 145C, 145D) may be substantially bigger than the beads in sections 140A-H, and may be implemented with semi-precious or precious gemstones for aesthetic emphasis, as well as to provide functional features in certain embodiments as described herein. As shown in the example of FIG. 2, the process continues until a pattern of four bead pattern sections (140A, 140B, 140C, and 140D) are provided, with each section comprising a first portion (142A, 142B, 142C, 142D) followed by a corresponding separator bead (145A, 145B, 145C, 145D).

In certain embodiments, after the last separator bead (e.g., 145D) is placed, the free end of wire 132 is strung through a connector bead 150. In one embodiment, connector bead 150 may be implemented using a commercially available "6/0" bead (approximately 4 mm long in an axial direction, and having a 1-mm diameter through hole), but other configurations are possible. Connector bead 150 comprises a first, proximal, end 153 (i.e., the end closest to brassiere hook 125, oriented toward the front of a woman's body in one embodiment) and a second, distal, end 155 (i.e., the end closest to brassiere hook 127, oriented toward the back of a woman's body in one embodiment). As described in more detail herein, in certain embodiments connector bead 150 joins the main beaded portion 130 of the brassiere strap 120 with elastic portion 170. In certain embodiments, connector bead 150 is not used, and the main beaded portion 130 of the brassiere strap 120 connects directly with elastic portion 170.

Still referring to the example shown in FIG. 2, after stringing wire 132 through connector bead 150, the free end of wire 132 is then threaded through separator bead 145D, this time in the opposite direction as the first time that wire 132 was threaded through separator bead 145D, such that wire 132 passes through separator bead 145D twice. Note that this exemplary procedure causes a small portion of wire 132 to be exposed, between the distal end 155 of connector bead 150 and the distal end of separator bead 145D. This exposed portion is typically substantially invisible to casual observers during normal use of strap 120, since the exposed portion of wire 132 is very small and because wire 132 may be clear or may have a color that otherwise camouflages wire 132 with respect to the beads in strap 120, including connector bead 150. Also, note that connector bead 150 may tend to rotate (i.e., distal end 155 of connector bead 150 may rotate toward hook 125) as tension is increased on wire 132. This feature may provide useful functional and aesthetic characteristics to strap 120, such as by facilitating coupling relatively elastic portion 170 to strap 120, as explained in more detail later.

Once the free end of wire 132 is strung through separator bead 145D on its return path toward hook 125, the bead stringing process shown in FIG. 2 proceeds essentially in reverse with respect to the procedure set forth above. Specifically, as shown in FIG. 2, a second portion 142E of bead pattern section 140D is formed, ending by stringing the free end of wire 132 through separator bead 145C. Then, a second portion 142F of bead pattern section 140C is formed, ending by stringing the free end of wire 132 through separator bead 145B. Then, a second portion 142G of bead pattern section 140B is formed, ending by stringing the free end of wire 132 through separator bead 145A. Finally, a second portion 142H of bead pattern section 140A is formed, and the free end of wire 132 is attached to brassiere hook 125 (e.g., by tying the end of wire 132 to a portion of hook 125 or via some other suitable mechanism). Thus, wire 132 is threaded through one or more bead pattern sections (e.g., 140A-D) in a second direction substantially opposite the first direction, then attached to the first hook 125. If tape or some other temporary means of preventing beads from falling off the first end 135 of wire 132 is used, it should be removed at this point and both ends of the wire 132 should be attached to hook 125 (e.g., by first tying the two ends of wire 132 together and then tying the joined ends of wire 132 to hook 125 using a double knot, by individually tying each end of wire 132 to hook 125, or via some other suitable mechanism).

Still referring to the example shown in FIG. 2, as will be explained in more detail below, to provide the relatively elastic portion 170 of strap 120, a segment of relatively elastic wire 175 is also threaded through connector bead 150, then loaded with beads, then attached at both ends to a second hook 127, such that the first hook 125 and the second hook 127 are at substantially opposite ends of the completed strap 120. In one embodiment, relatively elastic wire 175 may be implemented using Elasticity™ bead cord having 0.8 mm diameter, commercially available from the Beadalon™ company in a variety of colors, including clear bead cord. By labeling portion 170 of strap 120 as relatively elastic, it is simply pointed out that in some embodiments, portion 170 will generally be relatively more elastic than portion 130. In such a configuration, and with relatively elastic portion 170 located toward the rear of strap 120, the relatively inelastic main beaded portion 130 will experience less, if any, stretching and separation of beads and the related issues associated with revealing the underlying wire 132. Also, since strap 120 comprises both a relatively elastic portion 170 and a relatively inelastic portion 130, problems associated with continual stretching of strap 120 and possible permanent stretching and loss of support are lessened. Thus, strap 120 exhibits a useful balance of strength and stability that is provided by relatively inelastic portion 130, along with flexibility and adjustability that is provided by relatively elastic portion 170. In one embodiment, when strap 120 rests in an unstretched configuration, relatively inelastic portion 130 is approximately 8 inches long, and relatively elastic portion is approximately 3 inches long, although many other proportions and dimensions may be suitable, depending on the requirements of each particular implementation.

In one embodiment, to provide the relatively elastic portion 170 such as that shown in exemplary FIG. 2, a 6-inch length of 0.8 mm-diameter Elasticity™ bead cord 175 is prepared. One end of bead cord 175 is threaded through connector bead 150 (e.g., from distal end 155 to proximal end 153, or vice versa). Next, beads (such as the beads used in portions 142A-H) are strung onto both halves (172A & 172B) of bead cord 175, and finally the two ends of bead cord 175 are attached to second hook 127 (e.g., by first tying the two ends of bead cord 175 together and then tying the joined ends to hook 127 using a double knot, by individually tying each end of bead cord 175 to hook 127, or via some other suitable mechanism).

While the above description contains many specifics and certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art. For example, if so desired for particular implementations, relatively elastic portion 170 may include any suitable length adjustment mechanism to adapt strap 120 for use with a variety of users' body sizes. Also, as mentioned earlier, in certain embodiments, connector bead 150 is not used, and the main beaded portion 130 of the brassiere strap 120 connects directly with elastic portion 170. As another example, principles according to aspects of the present invention may be used in applications other than brassiere straps, such as g-strings, thongs, panties, one-piece swimsuits, bikini tops and bottoms, corsets, teddies, or similar items of clothing. In certain embodiments, one or more portions of the straps may not be loaded with beads. The invention includes any combination or subcombination of the elements from the different species and/or embodiments disclosed herein. One skilled in the art will recognize that these features, and thus the scope of the present invention, should be interpreted in light of the following claims and any equivalents thereto.

We claim:

1. A beaded brassiere strap, comprising:

a first beaded portion of a brassiere strap attached at a first end of said first beaded portion to a first brassiere attachment means and comprising a loop of low-elasticity beading wire threaded through a connector bead located at a second end substantially opposite said first end of said first beaded portion; and a second beaded portion of said brassiere strap attached at a first end of said second beaded portion to a second brassiere attachment means and comprising a loop of high-elasticity beading cord threaded through said connector bead, wherein said second brassiere attachment means is substantially opposite said first brassiere attachment means, wherein said connector bead is located between said first brassiere attachment means and said second brassiere attachment means, and wherein said connector bead joins said loop of low-elasticity beading wire and said loop of high-elasticity beading cord.

2. The beaded brassiere strap of claim 1, wherein said first and second brassiere attachment means comprise hooks.

3. A method of manufacturing a beaded brassiere strap, comprising:

coupling a first beaded portion of a brassiere strap at a first end of said first beaded portion to a first brassiere attachment means;

coupling said first beaded portion of said brassiere strap to a connector bead located at a second end of said first beaded portion substantially opposite said first end of said first portion, thereby forming a loop of low-elasticity beading wire;

coupling a first end of a second beaded portion of said brassiere strap to said connector bead, thereby forming a loop of high-elasticity beading cord; and coupling a second end of said second beaded portion of said brassiere strap to a second brassiere attachment means, wherein said second brassiere attachment means is substantially opposite said first brassiere attachment means and said connector bead joins said loop of low-elasticity beading wire and said loop of high-elasticity beading cord.

4. A method of manufacturing a beaded brassiere strap, comprising:

threading a first low-elasticity beading wire through a first set of one or more decorative beads;

threading said first low-elasticity beading wire through a first separator bead by inserting said first low-elasticity beading wire into a first opening in said first separator bead;

threading said low-elasticity beading first wire through a connector bead;

threading said first low-elasticity beading wire through said first separator bead by inserting said first low-elasticity beading wire into a second opening in said first separator bead;

threading said low-elasticity beading first wire through a second set of one or more decorative beads;

attaching the ends of said first low-elasticity beading wire to a first brassiere attachment hook, thereby forming a loop of low-elasticity beading wire;

threading a second high-elasticity beading wire through said connector bead; and attaching the ends of said second high-elasticity beading wire to a second brassiere attachment hook, thereby forming a loop of high-elasticity beading wire, wherein said second brassiere attachment hook is substantially opposite said first brassiere attachment hook, wherein said connector bead is located between said first brassiere attachment hook and said second brassiere attachment hook, and wherein said connector bead joins said loop of low-elasticity beading wire and said loop of high-elasticity beading wire.

5. A beaded brassiere strap, comprising:

a first beaded portion of a brassiere strap attached at a first end of said first beaded portion to a first brassiere attachment means and comprising a loop of low-elasticity beading wire coupled with a connector bead located at a second end substantially opposite said first end of said first beaded portion; and a second beaded portion of said brassiere strap forming a loop of high-elasticity beading wire coupled with said connector bead and with first beaded portion of said brassiere strap at said second end of said first beaded portion of said brassiere strap, and attached to a second brassiere attachment means, wherein said second brassiere attachment means is substantially opposite said first brassiere attachment means and wherein said connector bead joins said loop of low-elasticity beading wire and said loop of high-elasticity beading wire.

6. The beaded brassiere strap of claim 5, wherein said first and second brassiere attachment means comprise hooks.

7. The beaded brassiere strap of claim 5, wherein said loop of low-elasticity beading wire and said loop of high-elasticity beading wire are threaded through said connector bead.

8. The beaded brassiere strap of claim 7, wherein said first and second brassiere attachment means comprise hooks.

9. A method of manufacturing a beaded brassiere strap, comprising:

coupling a first beaded portion of a brassiere strap at a first end to a first brassiere attachment means;

forming a loop of low-elasticity beading wire at a second end of said first beaded portion substantially opposite said first end of said first beaded portion;

threading a first end of a second beaded portion of said brassiere strap through said loop, thereby forming a loop of high-elasticity beading wire; and coupling a second end of said second beaded portion of said beaded strap to a second brassiere attachment means, wherein said second brassiere attachment means is substantially opposite said first brassiere attachment means and wherein said loop of low-elasticity beading wire is joined with said loop of high-elasticity beading wire at a point between said first brassiere attachment means and said second brassiere attachment means.

10. The method of manufacturing a beaded brassiere strap of claim 3, wherein said coupling of said first beaded portion of said strap to said connector bead comprises threading said loop of low-elasticity beading wire through said connector bead, and wherein said coupling of said first end of said second beaded portion of said brassiere strap to said connector bead comprises threading said loop of high-elasticity beading cord through said connector bead.

11. The method of manufacturing a beaded brassiere strap of claim 3, wherein said first and second brassiere attachment means comprise hooks.

12. The method of manufacturing a beaded brassiere strap of claim 10, wherein said first and second brassiere attachment means comprise hooks.

* * * * *